US005901410A

United States Patent [19]

Windmeisser

[11] Patent Number: 5,901,410

[45] Date of Patent: May 11, 1999

[54] APPARATUS FOR CLEANING A FLOOR SURFACE

[75] Inventor: Dieter Windmeisser, Munchwilen, Switzerland

[73] Assignee: Diversey Lever Inc., Plymouth, Mich.

[21] Appl. No.: 08/808,758

[22] Filed: Mar. 3, 1997

[30] Foreign Application Priority Data

Mar. 1, 1996 [EP] European Pat. Off. ..... 96103116

[51] Int. Cl.[6] ..... A47L 5/34

[52] U.S. Cl. ..... 15/354; 15/320; 15/401

[58] Field of Search ..... 15/320, 322, 354, 15/359

[56] References Cited

U.S. PATENT DOCUMENTS

| | | | |
|---|---|---|---|
| 3,065,490 | 11/1962 | Arones | 15/359 |
| 3,942,214 | 3/1976 | Maasberg | 15/320 |
| 4,173,056 | 11/1979 | Geyer . | |
| 4,620,341 | 11/1986 | Rigby | 15/340.3 X |
| 4,817,233 | 4/1989 | Waldhauser . | |
| 4,955,254 | 9/1990 | Kohl et al. | 15/320 |
| 5,309,592 | 5/1994 | Hiratsuka . | |
| 5,319,828 | 6/1994 | Waldhauser et al. | 15/359 X |
| 5,465,456 | 11/1995 | Fellhauer | 15/339 X |

FOREIGN PATENT DOCUMENTS

| | | |
|---|---|---|
| 551 709 | 7/1993 | European Pat. Off. . |
| 19510340 | 11/1996 | Germany . |
| 486 499 | 6/1938 | United Kingdom . |
| 92/13480 | 8/1992 | WIPO . |

*Primary Examiner*—Chris K. Moore
*Attorney, Agent, or Firm*—Milton L. Honig

[57] ABSTRACT

Apparatus for cleaning a ground, comprising:

a frame;

rotatable brushing means arranged on the frame;

drive means for driving the brushing means;

suction means arranged behind the brushing means as seen in forward and/or rearward travel direction of the apparatus; and connecting means for connecting the suction means to the frame, wherein the connecting means are embodied such that the suction means can be displaced transversely relative to at least one direction of travel.

5 Claims, 2 Drawing Sheets

APPARATUS FOR CLEANING A FLOOR SURFACE

FIELD OF THE INVENTION

The present invention relates to a floor cleaning machine. In particular, it relates to a machine suitable for wet cleaning, comprising suction means for drawing up cleaning liquid applied to the floor surface.

BACKGROUND OF THE INVENTION

Cleaning apparatuses are known which are also capable of cleaning closely along a wall of a space, using a rotating brush and cleaning liquid. Manual cleaning work is hereby avoided as far as possible. In known cleaning apparatuses, which can usually operate in only one direction, suction means, usually in the form of so-called squeegees, for drawing up the cleaning liquid applied to the ground extend on at least one side of the apparatus further to the outside than a rotating brush.

Smaller apparatuses are further known, wherein suction means are arranged both in front of and behind a brush so that such a small apparatus can be used in both forward and rearward direction. Both respective suction means must extend further outward than a rotating brush for collecting all cleaning liquid used for cleaning a floor surface. As a consequence, brushing of a floor surface along a wall is a problem with these known cleaning apparatuses which can be used in two directions.

The object of the present invention is to obviate the above stated problem and/or to provide a compact apparatus which is easily manoeuvrable and/or can operate in two directions.

DEFINITION OF THE INVENTION

The present invention provides an apparatus for cleaning a ground, comprising:

a frame;

rotatable brushing means arranged on the frame;

drive means for driving the brushing means;

suction means arranged behind the brushing means as seen in forward and/or rearward travel direction of the apparatus; and connecting means for connecting the suction means to the frame, wherein the connecting means are embodied such that the suction means can be displaced transversely relative to at least one direction of travel.

DETAILED DESCRIPTION OF THE INVENTION

The suction means present in the apparatus of the invention preferably comprise a first suction member in front of the brushing means and a second suction member behind the brushing means. These suction members are preferably likewise arranged on a common housing. In this preferred embodiment the housing can be easily urged, for instance counter to spring action, out of a slightly sideways position into a position in which the housing and the suction members arranged thereon hardly protrude relative to the brushing means. As a result, the floor surface can be brushed clean precisely along an edge.

Figure 1:
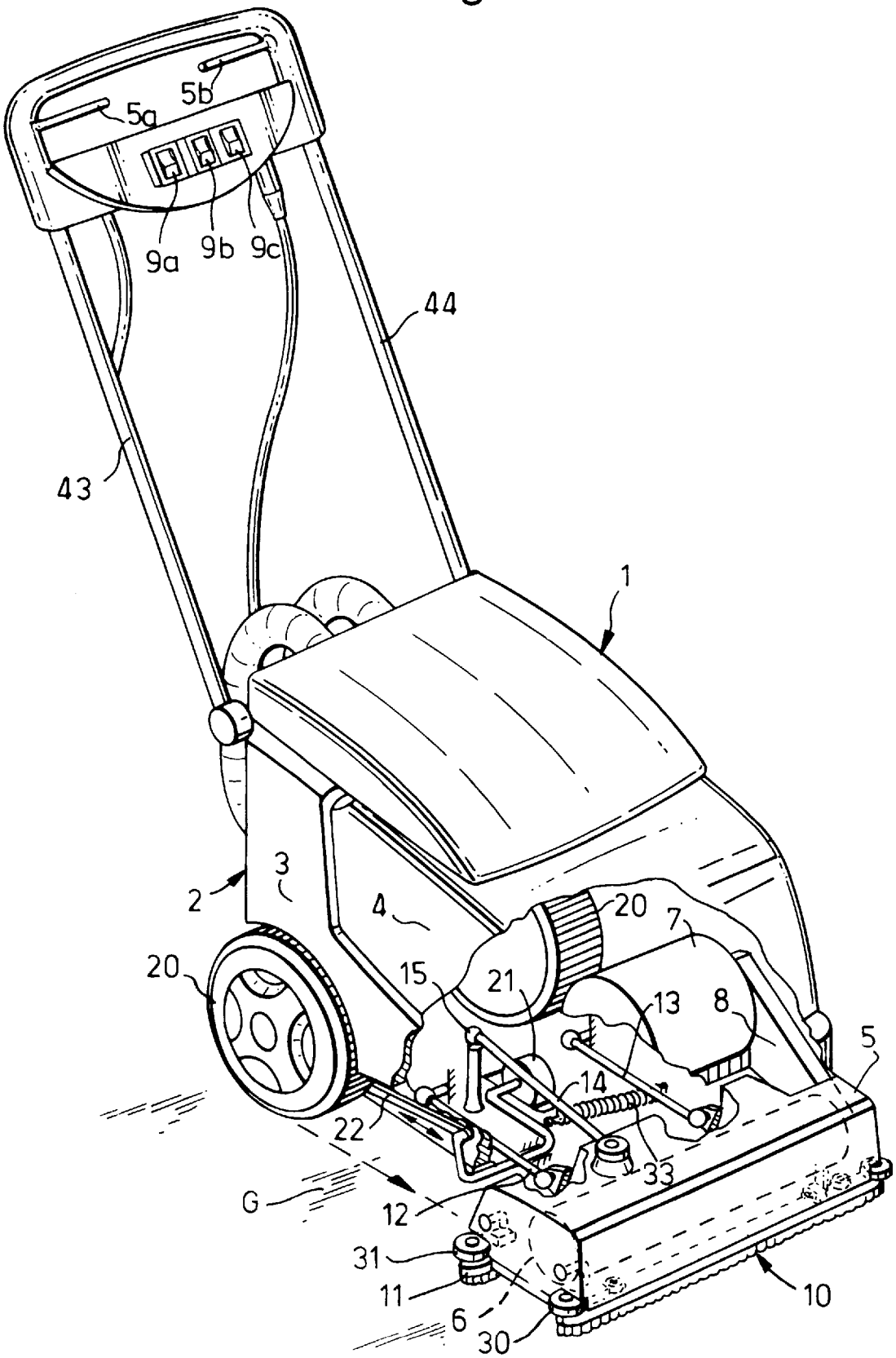
Figure 2:
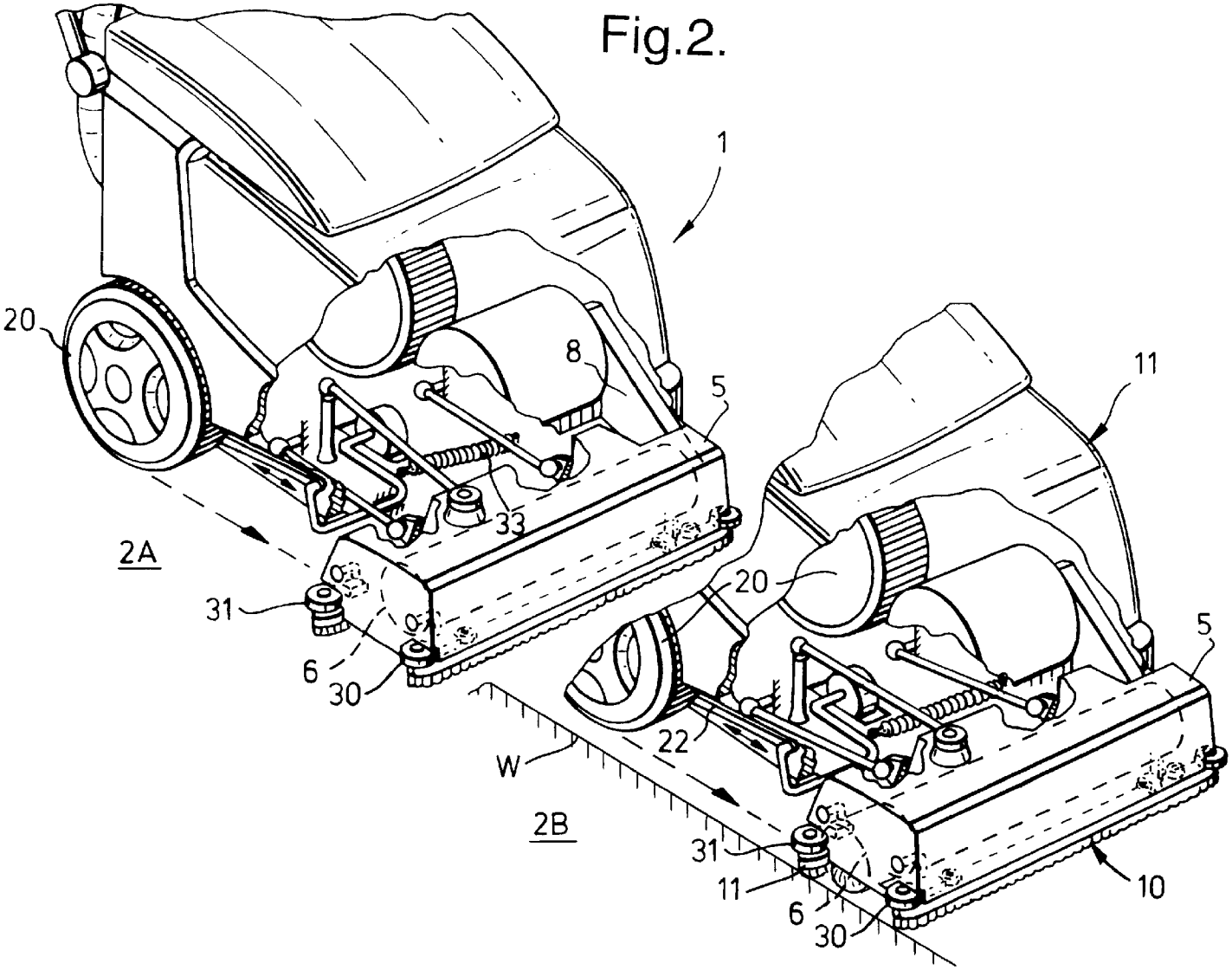

Further advantages, features and details of the present invention will be elucidated on the basis of the following description of a preferred embodiment thereof with reference to the annexed drawings, in which:

FIG. 1 shows a partly broken away view in perspective of a preferred embodiment of an apparatus according to the present invention; and FIG. 2 is a partly broken away view in perspective of the apparatus of FIG. 1 in two positions, respectively 2A and 2B.

An manually-operated floor scrubbing apparatus (FIG. 1) comprises a frame or chassis (2) to which tanks (3) and (4) respectively are arranged, for instance provided respectively with drawn up liquid and with cleaning liquid for applying to the ground surface (G). Push bars (43), (44) extend from chassis (2) to a position close to a transverse hand-grip, which extends transversely of the bars and in which are arranged switches (5), **(5*b*), (9*a*), (9*b*), and (9*c*) for actuating the different functions of apparatus (1), such as ON/OFF-suction, brushing etc. In a manner not shown, the tank (4) is connected to a housing (5) in which is situated a brush (6) which can be driven rotatably on a horizontal axis using a drive motor (7) and transmission means (8). The brushing operation is preferably performed by brush (6) while fresh cleaning liquid from tank (3) is supplied thereto. In front of and behind brush (6) so-called squeegees (10) and (11) extend substantially parallel to brush (6) and are connected to the other tank for drawing up the applied cleaning liquid. Apparatus (1) can be used in forward direction, wherein squeegee (11) provides the suction, as well as in rearward direction, wherein squeegee (10) provides the suction. In a manner not further shown the brush (6) is fixedly connected to chassis or frame (2). The housing is connected to the chassis by means of two support arms (12) and (13) which extend substantially parallel and which are preferably provided on both ends with ball joints. In order to prevent tilting of housing (5) when the direction of movement is reversed, i.e. from forward direction to rearward direction or vice versa, a stabilizer rod (14) is arranged on the upper side of housing (5), which rod is preferably connected with a ball joint (15)** to the chassis or frame.

Adjacently of the rear wheels, of which rear wheel (20) is shown in FIG. 1, the apparatus (1) is provided with a running wheel (21), which provides further support when the size of brush (6) is minimal, for instance due to wear thereof. The position of running wheel (21) can be adjusted using an adjusting mechanism (22).

As shown clearly in FIG. 2, the apparatus (1), when it approaches a wall W, can be pressed thereagainst with contact wheels (30) and (31), whereby the housing (5) is urged sideways out of the rest position, which in the shown embodiment is situated slightly to the right-hand side of brush (6) and rear wheel (20). The brush (6) can thus rotate directly along the wall W and there provide the required cleaning action.

As shown in FIGS. 1, 2A and 2B, the sideways movement is preferably brought about counter to the action of a coil spring (33), so that on leaving the cleaned area along the wall W the housing (5) with squeegees (10) and (11) is urged back to the position on the right-hand side as in FIG. 2A, wherein in order to properly draw up the liquid the squeegees (10) and (11) extend slightly further outward on the right-hand side of brush (6) than in the position shown in FIG. 2B. The transverse distance of the housing (5) between the positions shown in FIGS. 2A and 2B preferably amounts to about 20–50 mm, more preferably about 32 mm, this being sufficient to clean the edges along a wall adequately.

It will be apparent that the above mentioned sideways movement of housing (5) with squeegees (10) and (11) is possible in both the forward and rearward direction of travel of apparatus (1), whereby the edges along all walls of a space can be cleaned with the shown preferred embodiment.

It will likewise be apparent that using the support arms (12, 13) and stabilizer rod (14) a so-called cardan suspension is obtained of the housing (5) on which the squeegees are arranged, whereby unevenness in the ground can likewise easily be followed by the squeegees.

Within the scope of the following claims many modifications can be envisaged with respect to the above described preferred embodiment according to the present invention. This embodiment serves as illustration of the invention for which rights are applied in the following claims.

I claim:

1. An apparatus for cleaning a surface comprising:

(a) a frame;

(b) rotatable brushing means arranged on the frame;

(c) drive means for driving the brushing means;

(d) suction means arranged behind the brushing means as seen in at least one travel direction in either a forward or a rearward direction of the apparatus; and (e) connecting means for connecting the suction means to the frame, wherein the connecting means comprises at least two substantially parallel rods which are connected pivotally to the suction means at one end and arranged pivotally on the frame at the other, and wherein the connecting means are provided with spring means for holding the suction means in a desired position relative to the frame.

2. The apparatus according to claim 1, wherein the suction means comprise a first suction member in front of the brushing means and a second suction member behind the brushing means.

3. The apparatus according to claim 2, wherein the first suction member is arranged with the second suction member on a common housing.

4. The apparatus according to claim 1, wherein in their desired position the suction means extend slightly outward on one side relative to the frame and the brushing means.

5. The apparatus according to claim 1 wherein the connecting means are provided with stabilizing means comprising a stabilizing rod.

* * * * *